US008935945B2

(12) United States Patent
Shimoda

(10) Patent No.: US 8,935,945 B2
(45) Date of Patent: Jan. 20, 2015

(54) CONTROL SYSTEM

(75) Inventor: Naoki Shimoda, Tokyo (JP)

(73) Assignee: Toshiba Mitsubishi-Electic Industrial Systems Corporation, Tokyo (JP)

( * ) Notice: Subject to any disclaimer, the term of this patent is extended or adjusted under 35 U.S.C. 154(b) by 760 days.

(21) Appl. No.: 13/129,899

(22) PCT Filed: Nov. 19, 2008

(86) PCT No.: PCT/JP2008/071034

§ 371 (c)(1),
(2), (4) Date: May 18, 2011

(87) PCT Pub. No.: WO2010/058457

PCT Pub. Date: May 27, 2010

(65) Prior Publication Data

US 2011/0247381 A1 Oct. 13, 2011

(51) Int. Cl.
*B21B 37/74* (2006.01)

(52) U.S. Cl.
CPC ..... *B21B 37/74* (2013.01)
USPC ..... 72/202; 72/201; 72/12.2

(58) Field of Classification Search
CPC ..... B21B 38/006
USPC ..... 700/148, 153; 72/8.5, 12.2
See application file for complete search history.

(56) References Cited

U.S. PATENT DOCUMENTS

| | | | | |
|---|---|---|---|---|
| 6,430,461 | B1 * | 8/2002 | Andorfer et al. | 700/148 |
| 7,197,802 | B2 * | 4/2007 | Kurz et al. | 72/11.3 |
| 7,251,971 | B2 * | 8/2007 | Reinschke et al. | 72/8.5 |
| 8,500,927 | B2 * | 8/2013 | Tachibana et al. | 72/201 |
| 2006/0156773 | A1 * | 7/2006 | Kurz et al. | 72/8.5 |
| 2006/0225474 | A1 * | 10/2006 | Reinschke et al. | 72/8.5 |
| 2009/0139290 | A1 * | 6/2009 | Britanik et al. | 72/9.2 |

FOREIGN PATENT DOCUMENTS

| | | |
|---|---|---|
| JP | 1 306002 | 12/1989 |
| JP | 11 169903 | 6/1999 |
| JP | 2001 269702 | 10/2001 |
| JP | 2007 50416 | 3/2007 |

OTHER PUBLICATIONS

International Search Report Issued Jan. 20, 2009 in PCT/JP08/071034 filed Nov. 19, 2008.

* cited by examiner

*Primary Examiner* — Shelley Self
*Assistant Examiner* — Pradeep C Battula
(74) *Attorney, Agent, or Firm* — Oblon, Spivak, McClelland, Maier & Neustadt, L.L.P.

(57) ABSTRACT

A certain embodiment includes a predictive temperature calculator (101*a*) for dividing a steel sheet (14) to be heated and rolled in a hot rolling mill (20) into elements shaped annular for each space cutting width from an outer periphery to a center in a section thereof, and changing a time increment width in accordance with boundary conditions, for use of a difference method to calculate a predictive temperature for each of the divided elements, and a controller (101*b*) for operating on bases of predictive temperatures calculated by the predictive temperature calculator (101*a*), to determine control amounts for the hot rolling mill (20) to perform heating and rolling the steel sheet (14).

2 Claims, 6 Drawing Sheets

CONTROL SYSTEM

FIELD

Embodiments described herein relate generally to a control system adapted to calculate predictive values of temperatures of a steel sheet in a course of rolling in a hot rolling mill, with a relatively low calculation load, with good precision.

BACKGROUND

Typical hot rolling mills have a high temperature steel sheet reheated up to prescribed temperatures in a slab heating furnace, and transferred on a transfer line, undergoing a series of processes such as rolling processes, before a coiling by a coiler. To implement the rolling processes, there are control amounts, such as rolling loads and rolling torques, to be adjusted in accordance with temperatures of steel sheet. It therefore is necessary to calculate temperatures of steel sheet with good precision, affording to calculate control parameters for rolling processes with good precision.

Typical hot rolling mills have wide varieties of heat transfer phenomena, such as those in steel sheet transferring processes involving heat radiation, and water cooling at a descaler, a laminar spray cooler, etc., and those in rolling processes involving machining heat generation, frictional heat generation, roll heat transmission, and heat of transformation due to phase transition in steel sheet, causing surface temperatures of steel sheet to momentarily change. Further, inside steel sheet, there is conduction of heat due to differences relative to surface temperatures, causing temperatures in steel sheet also to change. Such being the case, various boundary conditions of steel sheet are changed, so changes of surface temperatures are large, whereas inside the steel sheet, where transfer of heat attributes simply to conduction of heat, temperature changes are gradual, so there are temperature differences developed between surface temperatures and internal temperatures, rendering temperatures distributed. In particular, as the thickness of steel sheet becomes larger, such temperature distributions get larger There are typical calculations to be made of surface temperatures of a steel sheet, where such wide varieties of changes in boundary conditions are taken into account to calculate quantities of efflux and influx heat to the steel sheet, to predict changes in surface temperatures of the steel sheet by calculation. Further, there are calculations to be made of temperatures in the steel sheet, which need a calculation of heat conduction due to temperature differences relative to the surfaces, to predict changes of internal temperatures by calculation.

Therefore, in conventional calculations of temperatures of a steel sheet, there were calculations made of quantities of efflux and influx heat through the surfaces for each boundary condition, subject to a simplification assuming an even temperature inside the steel sheet, for use of a heat capacity of the entire steel sheet to implement temperature calculations.

However, for temperatures of a state of steel sheet still thick in sheet thickness such as those in rough-rolling, there were large differences between surface temperatures and internal temperatures, so even if surface temperatures were temporarily lowered by, among others, roll heat conduction or water cooling in a descaling, such the state would be followed by risen surface temperatures due to heat conduction from inside the steel sheet, or the like, with a failure for such simplified temperature calculations as described to exactly calculate momentary changes of steel sheet temperatures.

Further, for steel sheet reheating control in a heating furnace or for thick plate rolling process or such, there were temperature calculations using a difference method, dividing a section of steel sheet into a mesh in, among others, the sheet thickness direction and the sheet width direction, taking into account heat conduction between elements, as well. However, such temperature calculation methods included dividing a section of steel sheet into a mesh, cutting also the lapse of time into time pitches, for use of a difference method to solve heat conduction equations to calculate temperatures, thus needing many calculation times, with an increased computer load, as an issue that constitute a difficulty in application of such temperature calculation methods to calculations for on-line control in actual operations of a hot rolling mill needing a real time nature.

To this point, Patent Literature 1 (JP 2001-269702 A) has proposed a method of using a difference method for temperature calculation, including depending on changes in thickness of a steel sheet such as in a rolling, to decrease a division number in a sheet thickness direction as the rolling progresses, allowing for a reduced load on the temperature calculation.

SUMMARY

However, the Patent Literature 1 (JP 2001-269702 A) following the rolling to decrease the division number in the sheet thickness direction is unable to decrease a division number in a sheet width direction. Further, to reduce the division number, if the element division is made simply for division in the sheet thickness direction, without division in the sheet width direction, to implement difference calculations, there would be a steel sheet still thick in sheet thickness such as just after discharge from a heating furnace, and subjected to a cooling or such by radiation from lateral sides, thus failing to make an exact representation of lateral side temperatures or such.

Further, to reduce the computer load, even if time increments are set long, trying to decrease the total number of times of calculation, there would be boundary conditions still subjected to large temperature changes such as at water cooling zones, failing to make a sufficiently exact temperature calculation or such, as an issue that constitute a difficulty in application of difference calculation to calculations for on-line control in actual operations.

Embodiments described herein have been devised in view of such issues, and have it as their objective to provide a control system adapted to calculate predictive temperatures of a steel sheet in a course of rolling in a hot rolling mill, with good precision, with a relatively low calculation load.

Advantageous Effects

According to embodiments herein, a steel sheet in a course of rolling in a hot rolling mill is allowed to have temperature predictive values calculated with good precision, with a relatively low calculation load.

BRIEF DESCRIPTION OF THE DRAWINGS

A configuration diagram showing configuration of a hot rolling mill to be controlled by a control system according to a first embodiment.

DETAILED DESCRIPTION

There will be described control systems according to embodiments, with reference to the drawings.

First Embodiment

Configuration

Figure 1:
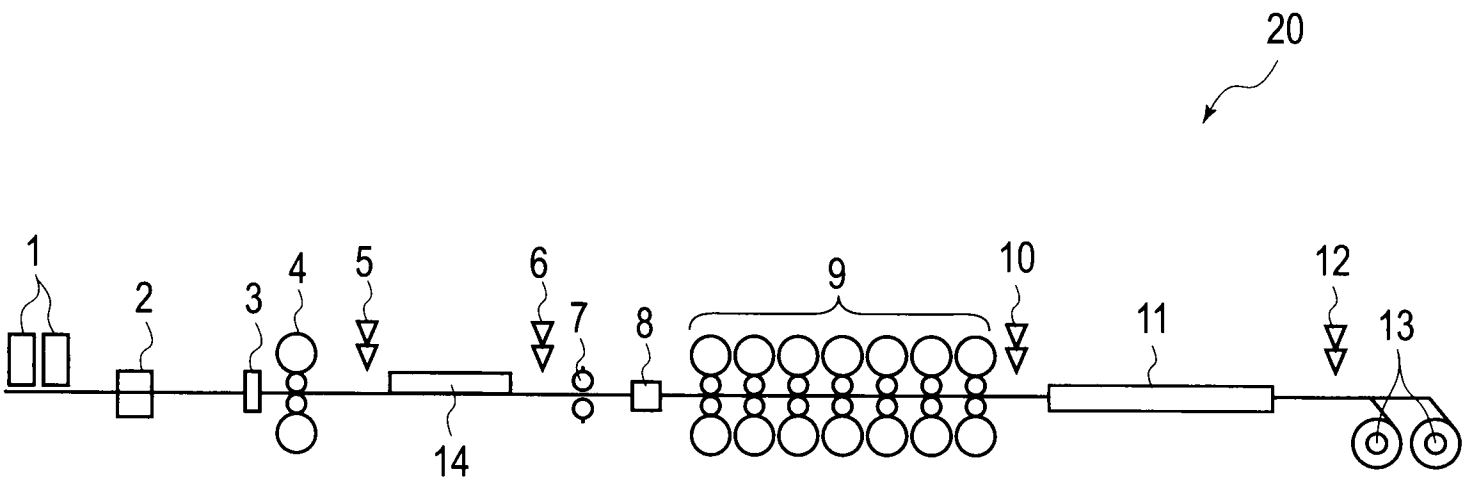

FIG. 1 is a configuration diagram showing configuration of a hot rolling mill to be controlled by a control system according to a first embodiment.

As shown in FIG. 1, the hot rolling mill 20 to be controlled by a control system according to the first embodiment includes slab heating furnaces 1 for reheating steel sheets 14, a high-pressure descaler 2 for injecting high-pressure water-jets to a steel sheet 14, from above and below, to remove scales from surfaces of the steel sheet 14, an edger 3 for rolling the steel sheet 14 in the sheet width direction, a rough mill 4 for rough-rolling the steel sheet 14, rough exit side thermometers 5 for measuring temperatures of the steel sheet 14 as rough-rolled by the rough mill 4, finish entry side thermometers 6 for measuring temperatures of the steel sheet 14 on the way to a crop shear 7 where it will be cut, the crop shear 7 being adapted to cut head and tail ends of the steel sheet 14, a finish entry side descaler 8 for removing scales from surfaces of the steel sheet 14, a finish mill 9 for finish-rolling the steel sheet 14 to a prescribed sheet thickness, finish exit side thermometers 10 for measuring temperatures of the steel sheet 14 as finish-rolled by the finish mill 9, a runout laminar spray cooler 11 for cooling the steel sheet 14, coiling thermometers 12 for measuring temperatures of the steel sheet 14 as cooled by the runout laminar spray cooler 11, and coilers 13 for coiling steel sheets 14.

Figure 2:
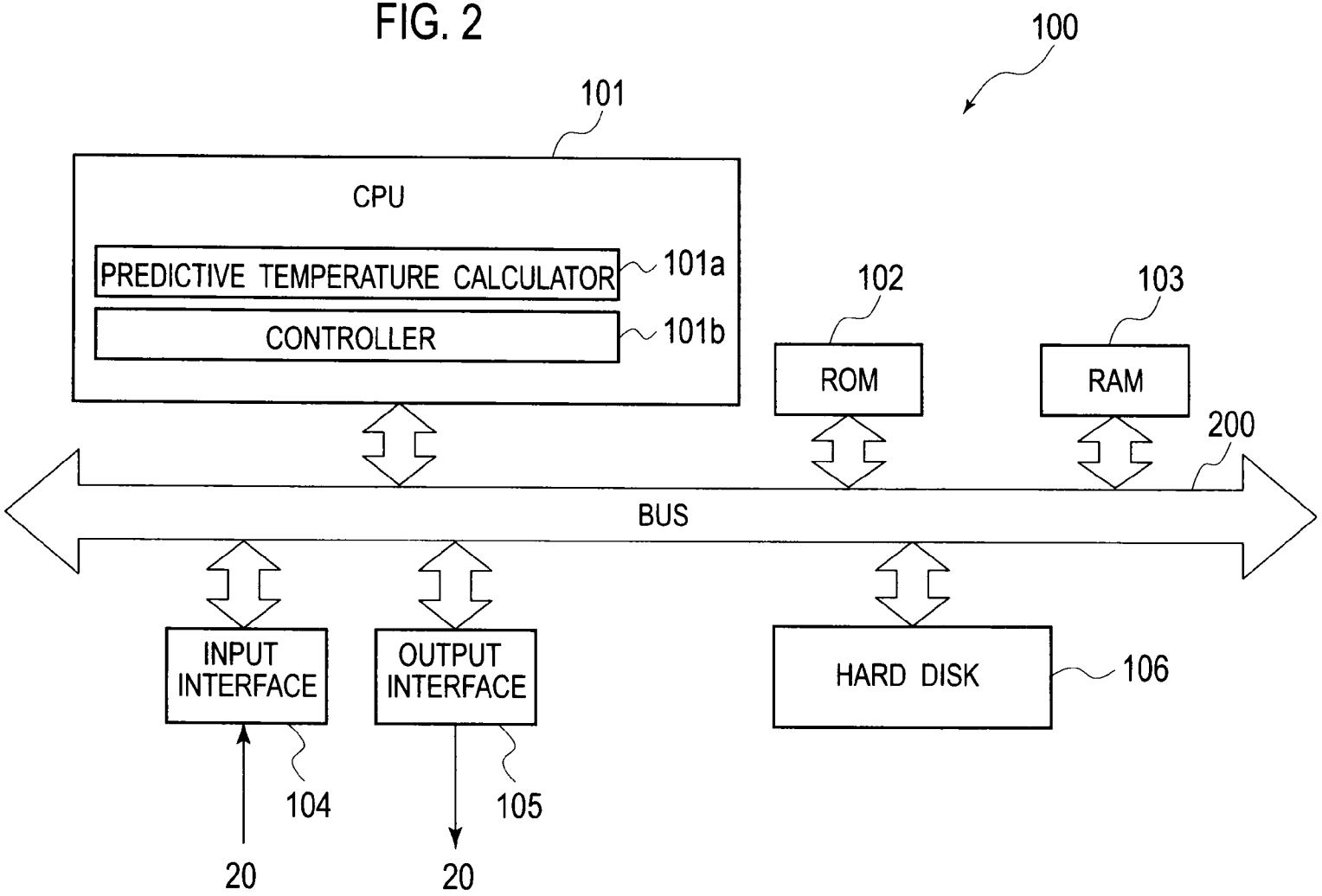
FIG. 2 A configuration diagram showing configuration of the control system according to the first embodiment.

FIG. 2 is a configuration diagram showing configuration of the control system according to the first embodiment.

As shown in FIG. 2, the control system 100 according to the first embodiment includes a ROM 102, a RAM 103, an input interface 104, an output interfarf 105, and a hard disc 106, while they are connected through buses 200.

The ROM 102 is composed of nonvolatile semiconductors or such, and adapted to store therein an operation system and the like to be executed at a CPU 101.

The RAM 103 is composed of volatile semiconductors or such, and adapted to store therein data and the like as necessary for the CPU 101 to implement various processes.

The input interface 104 is configured to receive, from the hot rolling mill 20, measures of temperatures measured by various thermometers such as rough exit side thermometers 5, finish entry side thermometers 6, finish exit side thermometers 10, and coiling thermometers 12, and process values such as those detected by sensors in the control system 100.

The output interface 105 is configured to transmit various control signals generated at the CPU 101, to the hot rolling mill 20.

The hard disc 106 is adapted to store therein programs to be executed at the CPU 101, such as those for control, as well as for predictive temperature calculation to calculate predictive temperatures.

The CPU 101 is adapted to implement a governing control for the control system 100. The CPU 101 is adapted to function for its services, including a predictive temperature calculator 101*a*, and a controller 101*b*.

The predictive temperature calculator 101*a* is configured for calculation of predictive temperatures, involving imaginarily dividing a section of steel sheet 14, from the periphery to the center, into a set of annular elements defined with a prescribed space cutting width. The predictive temperature calculator 101*a* is adapted for use of a difference method to calculate a predictive temperature for each divided element.

The controller 101*b* is configured to operate on bases of predictive temperatures calculated by the predictive temperature calculator 101*a*, to determine control amounts for the hot rolling mill 20 to implement reheating, rolling, and cooling a steel sheet 14, and on bases of thus determined control amounts, to control the hot rolling mill 20.

<Calculation of Predictive Temperatures>

Description is now made of a detail procedure for calculation of predictive temperatures at the predictive temperature calculator 101*a* of the CPU 101 in the control system 100 according to the first embodiment.

Figure 3:
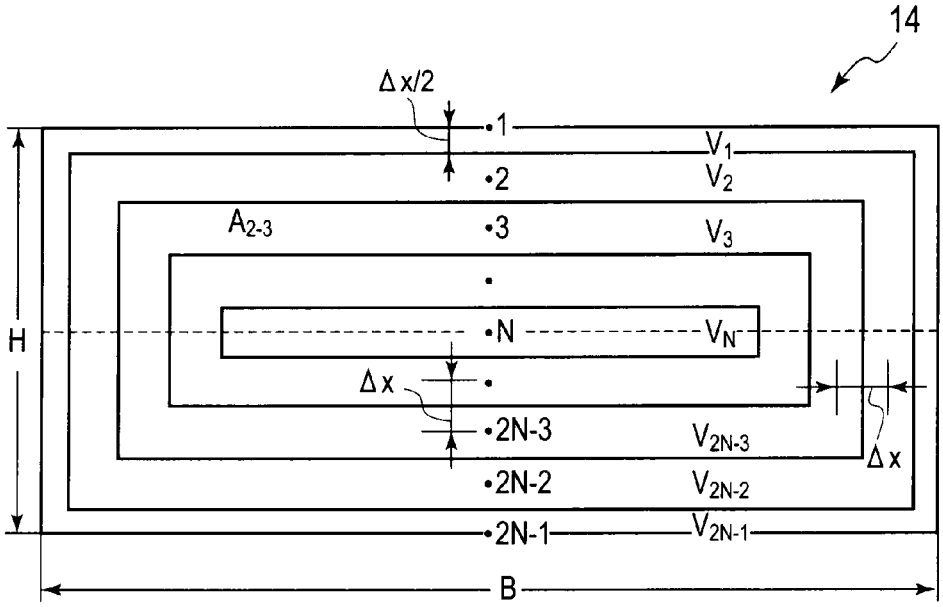
FIG. 3 An illustration of an element division process implemented at a section of a steel sheet by a predictive temperature calculator of a CPU in the control system according to the first embodiment.

FIG. 3 illustrates an element division process implemented at a section of steel sheet 14 by the predictive temperature calculator 101*a*.

In FIG. 3, designated at N is a division number representing the number of elements residing between a top region and a central region of a steel sheet 14, in the sheet thickness direction. The division number N is a division number corresponding to half the thickness of a steel sheet 14, so the steel sheet 14 has a total division number 2N−1 between a top region and a bottom region thereof.

In other words, letting $\Delta x$ be a space-cutting representative width, the predictive temperature calculator 101*a* first has an element divided from a combination of surfaces at the top and bottom and lateral sides of a steel sheet 14, in an annular shape with a width ($\frac{1}{2}\Delta x$) corresponding to half the space-cutting representative width. Then, the predictive temperature calculator 101*a* has a series of annular elements likewise divided inside that, at intervals of the space-cutting representative width ($\Delta x$) in both the sheet thickness direction and the sheet width direction. If the space-cutting representative width ($\Delta x$) is too small, the CPU 101 might suffer from enlarged loads, but if it is too large, there might be occurrences of failed calculation to predict exact temperatures. Accordingly, there may be need for adequate values calculated in advance on bases of actual measurements by a supplier or such, affording for the supplier or user or such to set up an adequate value in advance.

The predictive temperature calculator 101*a* similarly continues element division, till it comes to division of a central element. Further, except for the central element, each annular element is divided into combination of an upper half and a lower half, so that calculations for the upside and the downside can be separately made. By doing so, the predictive temperature calculator 101*a* divides a steel sheet 14 into 2N−1 elements in total.

Next, the predictive temperature calculator 101*a* calculates the volume and the boundary surface area of each element. There is a unit length taken in the transfer direction of steel sheet 14, whereby each element in a steel sheet 14 formed with a sheet thickness H and a sheet width B has a defined volume, which is calculated together with the areas of surfaces constituting boundaries between elements or to the surroundings.

More specifically, letting $V_1$ be the volume of a first element, $V_2$ be the volume of a second element, $V_3$ be the volume of a third element, $V_N$ be the volume of an N-th element, $V_{2N-3}$ be the volume of a (2N−3)-th element, $V_{2N-2}$ be the volume of a (2N−2)-th element, and $V_{2N-1}$ be the volume of a (2N−1)-th element, the predictive temperature calculator 101*a* is adapted for use of the following expression 1 to expression 7 to calculate $V_1$, $V_2$, $V_3$, $V_N$, $V_{2N-3}$, $V_{2N-2}$, and $V_{2N-1}$, respectively. It is noted that each of $V_1$, $V_2$, $V_3$, $V_N$, $V_{2N-3}$, $V_{2N-2}$, and $V_{2N-1}$ represents a volume per unit length of 1 mm in the transfer direction of steel sheet 14, and is expressed here in terms of ($mm^2$) omitting the factor corresponding to the unit length of 1 mm.

[Math 1]

$$V_1=\tfrac{1}{2}\{H\cdot B-(H-\Delta x)\cdot(B-\Delta x)\}(\mathrm{mm}^2) \quad \text{(expression 1)}$$

[Math 2]

$$V_2=\tfrac{1}{2}\{(H-\Delta x)\cdot(B-\Delta x)-(H-3\Delta x)\cdot(B-3\Delta x)\}(\mathrm{mm}^2) \quad \text{(expression 2)}$$

[Math 3]

$$V_3=\tfrac{1}{2}\{(H-3\Delta x)\cdot(B-3\Delta x)-(H-5\Delta x)\cdot(B-5\Delta x)\}(\mathrm{mm}^2) \quad \text{(expression 3)}$$

[Math 4]

$$V_N=\tfrac{1}{2}(H-2N-3)\Delta x)\cdot(B-(2N-3)\Delta x)(\mathrm{mm}^2) \quad \text{(expression 4)}$$

[Math 5]

$$V_{2N-3}=V_3=\tfrac{1}{2}\{(H-3\Delta x)\cdot(B-3\Delta x)-(H-5\Delta x)\cdot(B-5\Delta x)\}(\mathrm{mm}^2) \quad \text{(expression 5)}$$

[Math 6]

$$V_{2N-2}=V_2=\tfrac{1}{2}\{(H-\Delta x)\cdot(B-\Delta x)-(H-3\Delta x)\cdot(B-3\Delta x)\}(\mathrm{mm}^2) \quad \text{(expression 6)}$$

[Math 7]

$$V_{2N-1}=V_1=\tfrac{1}{2}\{H\cdot B-(H-\Delta x)\cdot\Delta x)\cdot(B-\Delta x)\}(\mathrm{mm}^2) \quad \text{(expression 7)}$$

Further, letting $A_{1\text{-}out}$ be the boundary surface area between the first element and the surroundings, $A_{1\text{-}2}$ be the boundary surface area between the first element and the second element, $A_{2\text{-}3}$ be the boundary surface area between the second element and the third element, $A_{(N-1)-N}$ be the boundary surface area between an (N−1)-th element and the N-th element, $A_{(2N-3)\text{-}(2N-2)}$ be the boundary surface area between the (2N−3)-th element and the (2N−2)-th element, $A_{(2N-2)\text{-}(2N-1)}$ be the boundary surface area between the (2N−2)-th element and the (2N−1)-th element, and $A_{(2N-1)\text{-}out}$ be the boundary surface area between the (2N−1)-th element and the surroundings, the predictive temperature calculator 101*a* is adapted for use of the following expression 8 to expression 14 to calculate $A_{1\text{-}out}$, $A_{1\text{-}2}$, $A_{2\text{-}3}$, $A_{(N-1)-N}$, $A_{(2N-3)\text{-}(2N-2)}$, $A_{(2N-2)\text{-}(2N-1)}$, and $A_{(2N-2)\text{-}(2N-1)}$, and $A_{(2N-1)\text{-}out}$ respectively. It is noted that each of $A_{1\text{-}out}$, $A_{1\text{-}2}$, $A_{2\text{-}3}$, $A_{(N-1)-N}$, $A_{(2N-3)\text{-}(2N-2)}$, $A_{(2N-2)\text{-}(2N-1)}$, and $A_{(2N-1)\text{-}out}$ represents a boundary surface area per unit length of 1 mm in the transfer direction of steel sheet 14, and is expressed here in terms of (mm) omitting the factor corresponding to the unit length of 1 mm.

[Math 8]

$$A_{1\text{-}out}=H+B(\mathrm{mm}) \quad \text{(expression 8)}$$

[Math 9]

$$A_{1\text{-}2}=(H-\Delta x)+(B-\Delta x)(\mathrm{mm}) \quad \text{(expression 9)}$$

[Math 10]

$$A_{2\text{-}3}=(H-3\Delta x)+(B-3\Delta x)(\mathrm{mm}) \quad \text{(expression 10)}$$

[Math 11]

$$A_{(N-1)-N}=\Delta x+(B-(2N-)\Delta x)(\mathrm{mm}) \quad \text{(expression 11)}$$

[Math 12]

$$A_{(2N-3)\text{-}(2N-2)}=A_{2\text{-}3}=(H-3\Delta x)+(B-3\Delta x)(\mathrm{mm}) \quad \text{(expression 12)}$$

[Math 13]

$$A_{(2N-2)-(2N-1)}=A_{1\text{-}2}=(H-\Delta x)+(B-\Delta x)(\mathrm{mm}) \quad \text{(expression 13)}$$

[Math 14]

$$A_{(2N-1)\text{-}out}=A_{1\text{-}out}=H+B(\mathrm{mm}) \quad \text{(expression 14)}$$

Next, the predictive temperature calculator 101*a* operates on each element, to calculate efflux and influx heat quantities during a time increment Δt.

Figure 4:
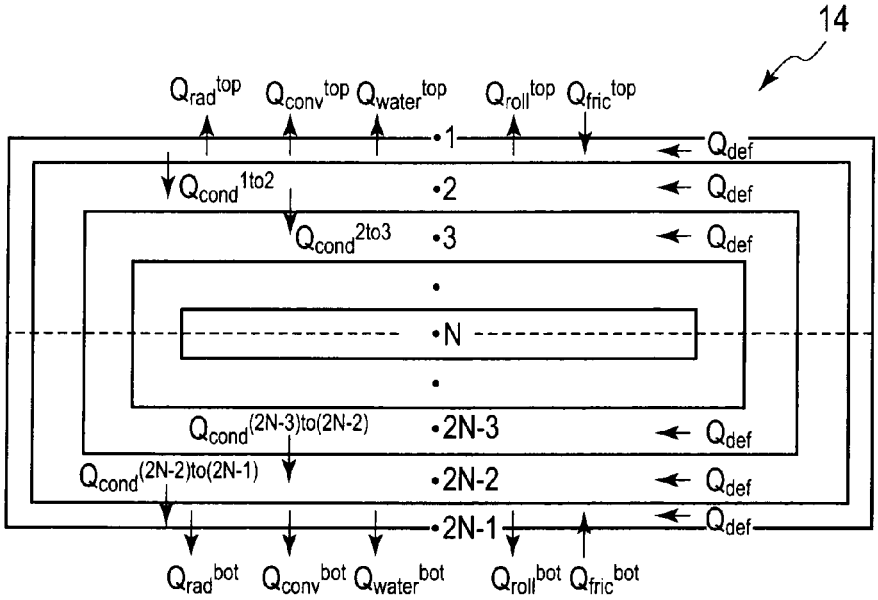
FIG. 4 A diagram describing quantities of efflux and influx heat to elements at a section of a steel sheet.

FIG. 4 is a diagram describing quantities of efflux and influx heat to elements at a section of a steel sheet 14.

As shown in FIG. 1, the hot rolling mill 20 has steel sheets 14 transferred through the slab reheating furnaces 1, the high pressure descaler 2, the edger 3, the rough mill 4, the crop shear 7, the finish entry side descaler 8, the finish mill 9, and the runout laminar spray cooler 11.

Each steel sheet 14 thus undergoes a series of processes in the hot rolling mill 20, subject to various effluxes and influxes of heat, such as by radiation, cooling, or machining friction heat generation, or roll heat convection. For a steel sheet 14, effluxes and influxes of heat to or from boundary conditions can be expressed as heat influxes or effluxes relative to the first element (upside) and the (2N−1)-th element (downside) being parts of an outermost enclosure, by the following expression 15 and expression 16, respectively. It is noted that the expression 15 as well as the expression 16 includes a radiation heat efflux, a cooling heat efflux, a convection heat efflux, a friction heat influx, a roll heat elimination, a machining heat generation, and a heat flux by conduction, as they are each calculated by using theoretical formula employed in a typical heat transfer theory or rolling theory.

[Math 15]

$$\Delta Q_1=-Q_{rad}^{Top}-Q_{water}^{Top}-Q_{conv}^{Top}+Q_{fric}^{Top}-Q_{roll}^{Top}+Q_{def}-Q_{cond}^{1to2}(\mathrm{W/mm}) \quad \text{(expression 15)}$$

[Math 16]

$$\Delta Q_{2N-1}=-Q_{rad}^{Bot}-Q_{water}^{bot}+Q_{conv}^{Bot}+Q_{fric}^{Bot}-Q_{roll}^{Bot}+Q_{def}+Q_{cond}^{(2N-2)to(2N-1)}(\mathrm{W/mm}) \quad \text{(expression 16)},$$

where, $\Delta Q_1$: quantity of influx heat to the first element during time increment Δt, $\Delta Q_{2N-1}$: quantity of influx heat to the (2N−1)-th element during time increment Δt, (W/mm), $Q_{rad}^{Top}$,$Q_{rad}^{Bot}$: radiation heat efflux from top face or bottom face of steel sheet, (W/mm), $Q_{water}^{Top}$,$Q_{water}^{Bot}$: cooling heat efflux from top face or bottom face of steel sheet in water cooling zone, (W/mm), $Q_{conv}^{Top}$,$Q_{conv}^{Bot}$: convection heat efflux from top face or bottom face of steel sheet in air cooling zone, (W/mm), $Q_{fric}^{Top}$,$Q_{fric}^{Bot}$: friction heat influx from top face or bottom face of steel sheet within rolling roll bite, (W/mm), $Q_{roll}^{Top}$,$Q_{roll}^{Bot}$: roll heat elimination from top face or bottom face of steel sheet within rolling roll bite, (W/mm), $Q_{def}$: machining heat generation at a respective element within rolling roll bite, (W/mm), $Q_{cond}^{1to2}$: heat flux by conduction from the first element to the second element due to temperature difference, (W/mm), and $Q_{cond}^{(2N-2)to(2N-1)}$: heat flux by conduction from the (2N−2)-th element to the (2N−1)-th element due to temperature difference, (W/mm).

It is noted that actually there are surrounding conditions varied along transfer, and based on to have $Q_{water}^{Top}$ or $Q_{water}^{Bot}$ applied simply in water cooling zones, $Q_{conv}^{Top}$ or $Q_{conv}^{Bot}$ applied simply in air cooling zones, and $Q_{fric}^{Top}$ or $Q_{fric}^{Bot}$, $Q_{fric}^{Bot}$, $Q_{roll}^{Top}$ or $Q_{roll}^{Bot}$, and $Q_{def}$ applied simply in rolling zones.

Next, the predictive temperature calculator 101*a* repeats an operation for use of the following expression 17 to calculate a quantity of influx heat to an i-th element (for i between 2 and (2N−2) both inclusive) during time increment Δt, (W/mm). It is noted that at any internal element the influx or efflux of heat attributes to the conduction of heat due to temperature difference between adjacent elements, and the generation of machining heat in rolling zones.

[Math 17]

$$\Delta Q=Q_i=Q_{cond}^{(i-1)to(i)}-Q_{cond}^{(i)to(i+1)}+Q_{def}(\text{W/mm}) \quad \text{(expression 17)},$$

where, $\Delta Q_i$: quantity of influx heat to an i-th element (for i between 2 and (2N−2) both inclusive) during time increment Δt, (W/mm), $Q_{cond}^{(i-1)to(i)}$: heat flux by conduction from an (i−1)-th element to the i-th element due to temperature difference, (W/mm), $Q_{cond}^{(i)to(i+1)}$: heat flux by conduction from the i-th element to an (i+1)-th element due to temperature difference, (W/mm), and $Q_{def}$: machining heat generation at a respective element within rolling roll bite (applicable simply in rolling zones), (W/mm).

Next, the predictive temperature calculator 101*a* repeats an operation for use of the following expression 18 to calculate a temperature variation of an i-th element during time increment Δt.

[Math 18]

$$\Delta T_i = \frac{\Delta Q_i}{\rho \cdot Cp_i \cdot V_i} \cdot \Delta t, \quad \text{(expression 18)}$$

where, $\Delta T_i$: variation in temperature of the i-th element during time increment Δt, (K).

ρ: density, (kg/mm$^3$), $Cp_i$: specific heat of the i-th element, (J/kg/K), and $V_i$: volume of the i-th element, (mm$^2$).

Then, the predictive temperature calculator 101*a* repeats an operation for use of an expression 19 to calculate temperatures after lapse of time increment Δt, as predictive temperatures.

[Math 19]

$$T_i^{j+1}=T_i^j+\Delta T_i \quad \text{(expression 19)},$$

where, $T_i^j$: temperature of an i-th element at a time step j, (K), and $T_i^{j+1}$: temperature of the i-th element at a time step (j+1) after time increment Δt, (K).

The predictive temperature calculator 101*a* thus has a quantity of influx or efflux heat, a temperature change, and a temperature of divided element, calculated every time step for each of the first to the (2N−1)-th element, which process for current time step is repeated till it comes to an end of an entire interval of time as necessary for transfer of a steel sheet 14, thereby calculating a temperature distribution of the steel sheet 14.

As will be seen from the foregoing, the predictive temperature calculator 101*a* is configured to divide a steel sheet 14 being hot-rolled in the hot rolling mill 20, into elements shaped annular, from outside to the inside, with the lateral sides inclusive, thereby allowing for use of a difference method to calculate predictive temperatures, taking into account lateral side temperatures and boundary conditions, as well, even for steel materials thick in sheet thickness. Like this, dividing a steel sheet 14 into annular elements affords to make the division number smaller, than dividing in both sheet thickness and sheet width directions for a division into two-dimensional mesh, thus allowing for a reduced computer load for on-line control calculations in real operation.

Therefore, according to the first embodiment, there is a control system 100 adapted to calculate predictive temperatures of a steel sheet being rolled in a hot rolling mill 20, with good precision with relatively low computation load.

Second Embodiment

Description is now made of a control system 100 according to a second embodiment.

Like the control system 100 according to the first embodiment shown in FIG. 2, the control system 100 according to the second embodiment includes a CPU 101, a ROM 102, a RAM 103, an input interface 104, an output interface 105, and a hard disc 106.

In the control system 100 according to the second embodiment, the CPU 101 has a predictive temperature calculator 101*a* additionally adapted to operate on bases of boundary conditions of a steel sheet 14, to calculate an increment width of time for use in a difference method, and change the calculated time increment width to calculate a predictive temperature for each divided element.

Description is now made of a detail procedure for calculation of predictive temperatures at the predictive temperature calculator 101*a* of the CPU 101 in the control system 100 according to the second embodiment.

Figure 5:
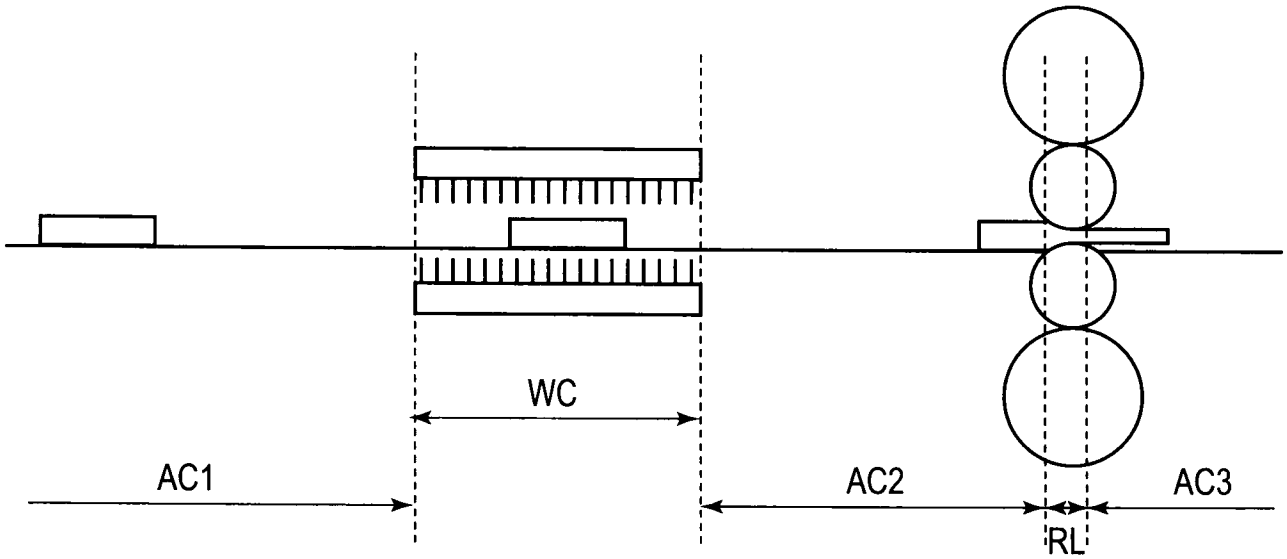
FIG. 5 A diagram describing patterns of boundary conditions causing changes in temperature of a steel sheet in a hot rolling mill under control of a control system according to a second embodiment.

FIG. 5 is a diagram describing patterns of boundary conditions causing changes in temperature of a steel sheet 14 in a hot rolling mill 20. Here, the boundary conditions refer to regions of environments causing changes in influx or efflux of heat to the steel sheet 14. In FIG. 5, the pattern diagram illustrates a set of air cooling transfer zones AC1, AC2, and AC3, a water cooling transfer zone WC, and a rolling zone RL, as associated boundary conditions.

For instance, in the hot rolling mill 20 shown in FIG. 1, the high-pressure descaler 2, the finish entry side descaler 8, sprayers installed in the finish mill 9, and the runout laminar spray cooler 11 each constitute a water cooling transfer zone WC. Further, the rough mill 4 and the finish mill 9 each constitute a rolling zone RL, there being other transfer zones each constituting an air cooling transfer zone AC1, AC2, or AC3.

For a respective one of such boundary conditions, there is a temperature change per unit time (dT/dt) defined by the following expression 20 derived from the expression 18.

[Math 20]

$$\frac{dT}{dt} = \frac{\Delta T}{\Delta t} = \frac{\sum \Delta Q}{\rho \cdot Cp \cdot V} \quad \text{(expression 20)}$$

Further, taking a unit length in the transfer direction of a steel sheet 14, while letting H be the sheet thickness of the steel sheet 14, and B be the sheet width of the steel sheet 14, the entirety of this section of steel sheet 14 has a volume V, such that:

[Math 21]

$$V = H \times B \quad \text{(expression 21)}$$

Then, the predictive temperature calculator 101*a* calculates, for the entirety of steel sheet 14, a mean temperature change per unit time (dT/dt) at a respective boundary condition, that is, for each of air cooling transfer zones AC1 to AC3, water cooling transfer zones WC, and rolling zones RL.

First, the predictive temperature calculator 101*a* operates at the air cooling transfer zones AC1 to AC3, for use of the following expression 22 to calculate a mean temperature change per unit time (dT/dt) for the entirety of steel sheet 14.

[Math 22]

$$\frac{dT}{dt} = \frac{-Q_{rad}^{Top} - Q_{rad}^{Bot} - Q_{conv}^{Top} - Q_{conv}^{Bot}}{\rho \cdot Cp \cdot H \cdot B}, \quad \text{(expression 22)}$$

where, $Q_{rad}^{Top}$: radiation heat efflux from top face or bottom face of steel sheet, (W/mm), and $Q_{conv}^{Top}, Q_{conv}^{Bot}$: convection heat efflux from top face or bottom face of steel sheet in air cooling zone, (W/mm).

Further, the predictive temperature calculator 101*a* operates at the water cooling transfer zones WC, for use of the following expression 23 to calculate a mean temperature change per unit time (dT/dt).

[Math 23]

$$\frac{dT}{dt} = \frac{-Q_{water}^{Top} - Q_{water}^{Bot}}{\rho \cdot Cp \cdot H \cdot B}, \quad \text{(expression 23)}$$

where, $Q_{water}^{Top}, Q_{water}^{Bot}$: cooling heat efflux from top face or bottom face of steel sheet in water cooling zone, (W/mm).

Further, the predictive temperature calculator 101*a* operates at the rolling zones RL, for use of the following expression 24 to calculate a mean temperature change per unit time (dT/dt).

[Math 24]

$$\frac{dT}{dt} = \frac{Q_{fric}^{Top} - Q_{roll}^{Top} + Q_{fric}^{Bot} - Q_{roll}^{Bot} + Q_{def}^{Tot}}{\rho \cdot Cp \cdot H \cdot B}, \quad \text{(expression 24)}$$

where, $Q_{fric}^{Top}, Q_{fric}^{Bot}$: friction heat influx from top face or bottom face of steel sheet within rolling roll bite, (W/mm), $Q_{roll}^{Top}, Q_{roll}^{Bot}$: roll heat elimination from top face or bottom face of steel sheet within rolling roll bite, (W/mm), and $Q_{def}^{Tot}$: machining heat generation of entire inside of steel sheet within rolling roll bite, (W/mm).

Next, the predictive temperature calculator 101*a* operates for use of the following expression 25 to calculate a time increment At to apply to temperature difference calculations at respective boundary conditions of air cooling transfer zones AC1 to AC3, water cooling transfer zones WC, and rolling zones RL.

[Math 25]

$$\Delta t = \Delta T_{inc} \div \frac{dT}{dt} \quad \text{(expression 25)}$$

Here, $\Delta T_{inc}$ is a standard increment of temperature change per one time step in temperature calculation, that represents a change of temperature as necessary for precision of temperature calculation.

Typically, $\Delta T_{inc}$ used is a numerical value of 1° C. or less. If $\Delta T_{inc}$=1 (° C.), for instance, the time increment Δt required in the expression 25 represents a mean necessary time for the temperature to change by 1 (° C.). Typically, water cooling transfer zones WC have larger quantities of heat $Q_{water}$ transferred by water cooling heat conduction in comparison with air cooling transfer zones AC1 to AC3, and have shorter time increments Δt than air cooling transfer zones AC1 to AC3. On the other hand, air cooling transfer zones AC1 to AC3 have gradual temperature changes, and can take long time increments even with an identical $\Delta T_{inc}$=1 (° C.), allowing for a secured precision of temperature calculation with a reduced number of calculation times, with a reduced computer load.

Figure 6:
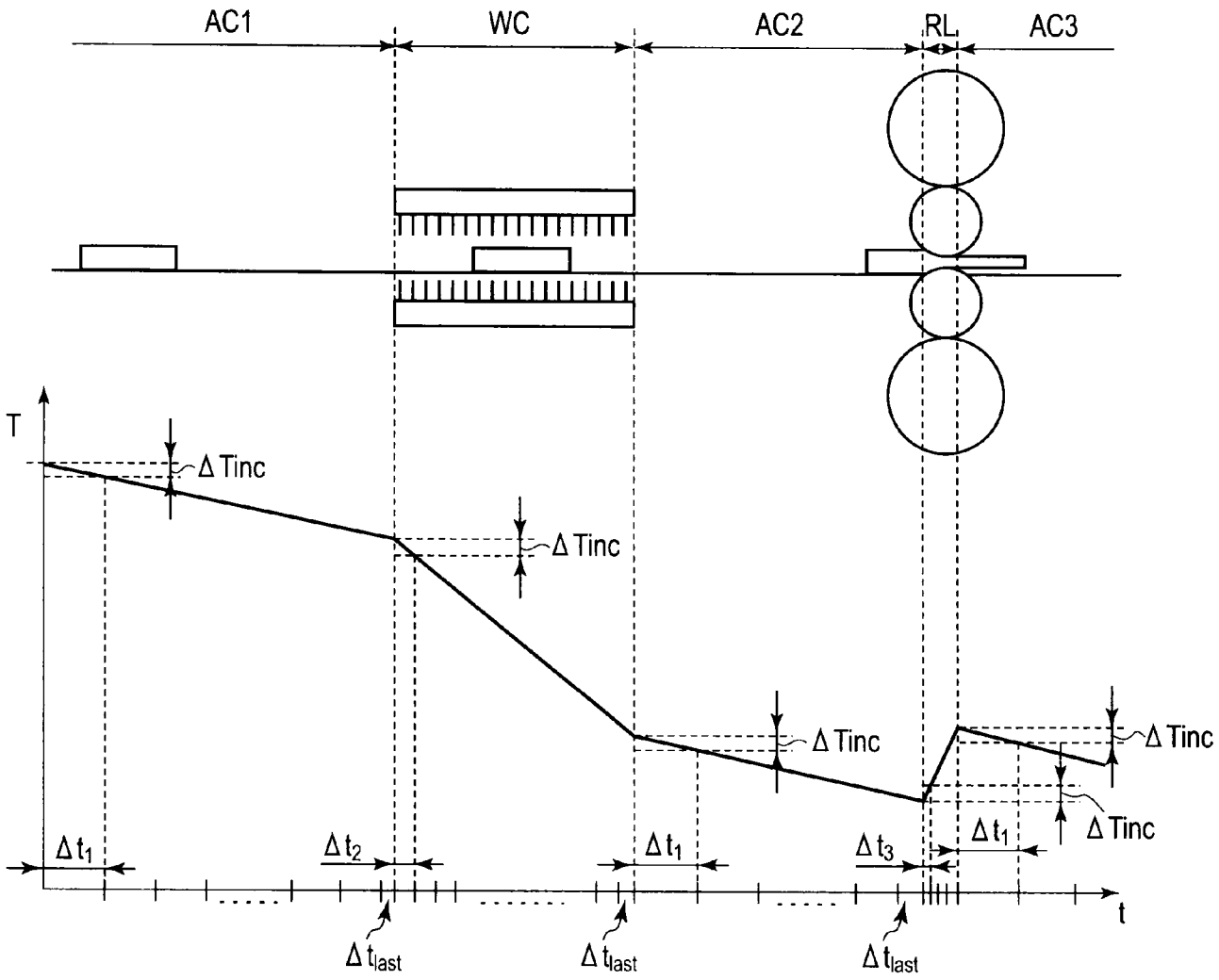
FIG. 6 A diagram describing changes in temperature of a steel sheet in the hot rolling mill under control of the control system according to the second embodiment.

FIG. 6 is a diagram describing temperature changes of a steel sheet 14 in the hot rolling mill 20.

As illustrated in FIG. 6, the predictive temperature calculator 101*a* operates to have a time increment changed to $\Delta t_1$ for the air cooling transfer zones AC 1 to AC3, or $\Delta t_2$ for the water cooling transfer zone WC, or $\Delta t_3$ for the rolling zone RL, to implement temperature difference calculations. There is a final step in each boundary condition, where the calculation is made for a last time increment $\Delta t_{last}$, such that $\Delta t_{last} < \Delta t_{last} \leq \Delta t$.

It is noted that for difference calculations using an explicit method not to have diverged calculation results, the time increment should meet the following expression as a constraint from space cutting width.

[Math 26]

$$\Delta t \leq \frac{1}{2} \frac{\rho \cdot Cp}{\lambda} (\Delta x)^2 \quad \text{(expression 26)}$$

Here, ρ is density, Cp is specific heat, and λ is thermal conductivity. This constraint condition is unnecessary for use of implicit methods such as Crank-Nicolson method.

As will be seen from the foregoing, according to the second embodiment, there is a control system 100 adapted to have time increments changed depending on variations of boundary conditions, such as those of air cooling transfer zones AC1 to AC3, water cooling transfer zones WC, and rolling zones RL, to implement temperature difference calculations, allowing for a secured precision of temperature change per one time step, while preventing the total number of times of calculation from getting as many as redundant, affording to hold the number of times adequate. Accordingly, for a hot rolling mill 20 to be put in service, there is achieved adaptation for the temperature distribution of steel sheet to be calculated more exactly, with a reduced calculation load on on-online calculation in real operation of the hot rolling mill 20.

Third Embodiment

Description is now made of a control system 100 according to a third embodiment.

Like the control system 100 according to the first embodiment shown in FIG. 2, the control system 100 according to the third embodiment includes a CPU 101, a ROM 102, a RAM 103, an input interface 104, an output interface 105, and a hard disc 106.

In the control system 100 according to the third embodiment, the CPU 101 has a predictive temperature calculator 101*a* additionally adapted to operate on bases of measured temperatures measured by rough exit side thermometers 5, finish entry side thermometers 6, finish exit side thermometers 10, and coiling thermometers 12, as they are installed in a hot rolling mill 20, to correct a predictive temperature for each divided element, to provide a new predictive temperature.

Description is now made of a detail procedure for calculation of predictive temperatures at the predictive temperature calculator 101*a* of the CPU 101 in the control system 100 according to the third embodiment.

Figure 7:
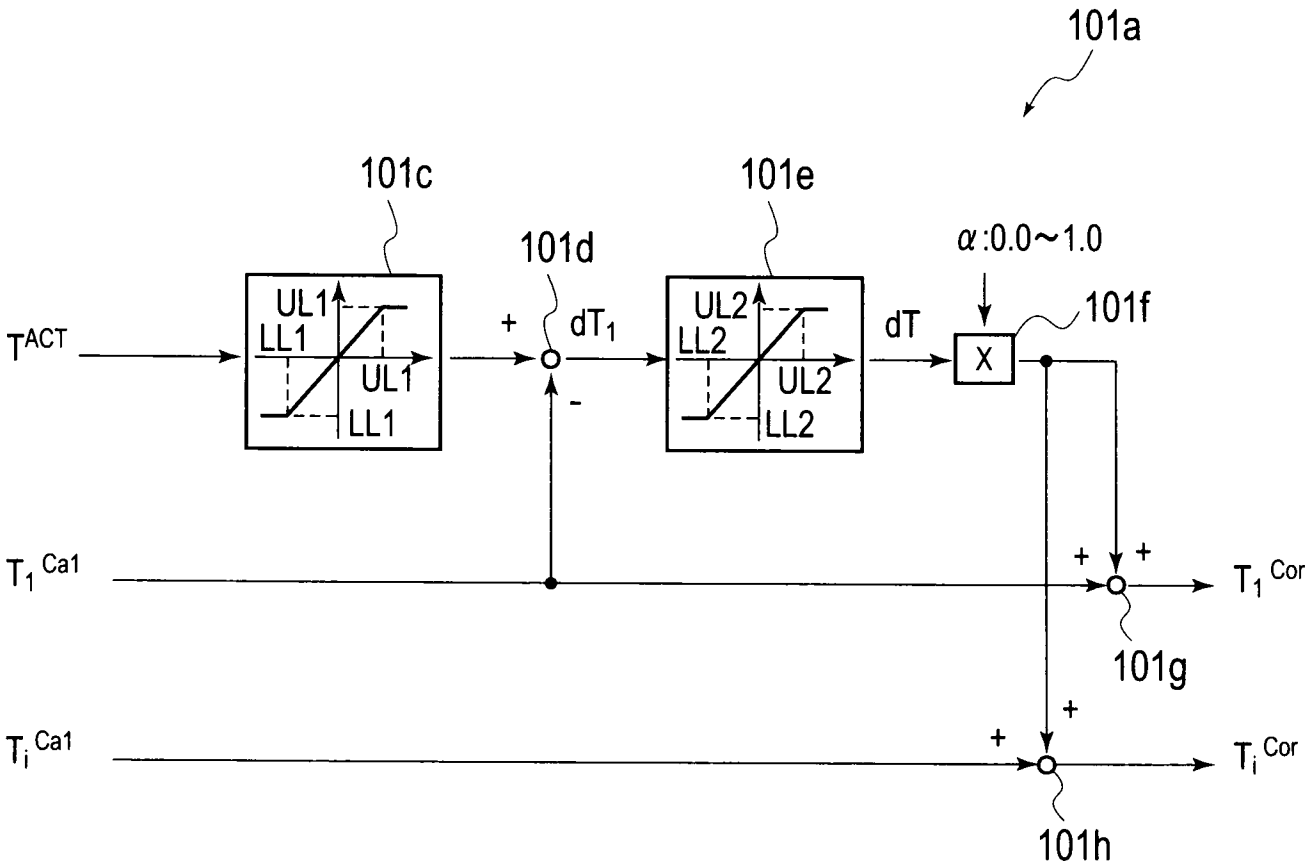
FIG. 7 A diagram describing a process of computing predictive temperatures at a predictive temperature calculator of a CPU in a control system according to a third embodiment.

FIG. 7 is a diagram describing a process of computing predictive temperatures at the predictive temperature calculator 101*a* of the CPU 101 in the control system 100 according to the third embodiment.

First, the predictive temperature calculator 101*a* operates with measures of actual temperature $T^{ACT}$ of a steel sheet measured at the rough exit side thermometers 5, the finish entry side thermometers 6, the finish exit side thermometers 10, or the coiling thermometers 12 and supplied thereto from the hot rolling mill 20, to perform an upper and lower limit check of measures of temperature $T^{ACT}$. More specifically, the predictive temperature calculator 101*a* has an upper and lower limiter 101*c* configured as shown in FIG. 7 with a function stored therein, the upper and lower limiter 101*c* being operable for any supplied measure of temperature $T^{ACT}$ in between a lower limit LL1 and an upper limit UL1, to output a value commensurate with the measure of temperature $T^{ACT}$ as a measure of temperature. The upper and lower limiter 101*c* is operable for any supplied measure of temperature $T^{ACT}$ equal to or smaller than the lower limit LL1, to output the LL1 as a measure of temperature, and for any supplied measure of temperature $T^{ACT}$ equal to or larger than the upper limit UL1, to output the UL1 as a measure of temperature.

Next, the predictive temperature calculator 101*a* operates to have a deviation between a calculated predictive temperature $T_1^{Cal}$ of a first (upside) element and a measure of temperature output from the upper and lower limiter 101*c*. More specifically, there is a subtractor 101*d* for calculating a difference d $T_1$ between the calculated predictive temperature $T_1^{Cal}$ of the first (upside) element and the measure of temperature output from the upper and lower limiter 101*c*.

Then, the predictive temperature calculator 101*a* operates to perform an upper and lower limit check of a difference d $T_1$ output from the subtractor 101*d*. More specifically, the predictive temperature calculator 101*a* has an upper and lower limiter 101*e* configured as shown in FIG. 7 with a function stored therein, the upper and lower limiter 101*e* being operable for any supplied difference d $T_1$ in between a lower limit LL2 and an upper limit UL2, to output a value commensurate with the difference d $T_1$ as a difference d T. The upper and lower limiter 101*e* is operable for any supplied difference d $T_1$ equal to or smaller than the lower limit LL2, to output the LL2 as a difference d T, and for any supplied difference d $T_1$ equal to or larger than the upper limit UL2, to output the UL2 as a difference d T.

Next, the predictive temperature calculator 101*a* operates on a difference d T having undergone the upper and lower limit check at the upper and lower limiter 101*e*, to multiply by an adjustment gain α, to add to the original predictive temperature $T_1^{Ca1}$ of the first (upside) element. It is noted that the adjustment gain is set to a value within a range of "0.0" to "1.0", whereby if the value of adjustment gain is "0.0", the measure of temperature is left uncorrected, but if the value of adjustment gain is "1.0", the measure of temperature is to replace. More specifically, there is combination of a multiplier 101*f* for multiplying the difference d T by an adjustment gain α, and an adder 101*g* for adding the αdT to the predictive temperature $T_1^{Cal}$ to calculate a predictive temperature $T_1^{Cor}$.

In other words, the predictive temperature calculator 101*a* is adapted for use of the following expression 27 to calculate a corrected predictive temperature $T_1^{c"}$ of the first (upside) element.

[Math 27]

$$T_1^{Cor}=T_1^{Cal}+\alpha(T^{Act}-T_1^{Cal}) \quad \text{(expression 27)},$$

where, $T_1^{Cal}$: original predictive temperature of first (upside) element, (° C.), $T^{Act}$: measure of temperature by thermometer, (° C.), $T_1^{Cor}$: corrected predictive temperature of first (upside) element, (° C.), and α: adjustment gain Then, the predictive temperature calculator 101*a* operates for a respective element else in the steel sheet 14, to add thereto the same amount of correction as above, without exception. More specifically, there is an adder 101*h* for adding the αdT to a predictive temperature $T_i^{Ca1}$ to calculate a predictive temperature $T_i^{Cor}$.

In other words, the predictive temperature calculator 101*a* is adapted for use of the following expression 28 to calculate a corrected predictive temperature $T_i^{Cor}$ of an i-th element.

[Math 28]

$$T_i^{Cor}=T_i^{Cal}+\alpha\cdot(T^{Act}-T_1^{Cal}) \quad \text{(expression 28)},$$

where, $T_i^{Cal}$: original predictive temperature of i-th element, (° C.), and $T_i^{Cor}$: corrected predictive temperature of i-th element, (° C.).

Such being the case, each element has a temperature corrected to take as an initial temperature to promote difference temperature calculations in subsequent transfer zones.

As will be seen from the foregoing, according to the third embodiment, there is a control system 100 adapted to operate on bases of measures of temperatures measured by thermometers installed in a hot rolling mill 20, for correcting a temperature of each divided element to continue difference temperature calculations, allowing for predictive temperatures of a steel sheet 14 to be calculated with higher precision.

INDUSTRIAL APPLICABILITY

Embodiments herein have applications to a control system for controlling hot rolling mills.

The invention claimed is:

1. A control system comprising:

a predictive temperature calculator configured to divide a steel sheet in a course of heating, rolling, and cooling in a hot rolling mill into annular shaped elements for each space cutting width from an outer periphery to a center in a section thereof, calculate a temperature variation during a time increment for each of the divided elements, and calculate a predictive temperature for each of the divided elements by adding the temperature variation; and a controller configured to operate on the basis of predictive temperatures calculated by the predictive temperature calculator, to determine control amounts for the hot rolling mill to implement heating, rolling, and cooling of the steel sheet, wherein the predictive temperature calculator is configured to calculate a quantity of influx heat during the time increment for each of the divided elements, calculate a temperature variation during the time increment for each of the divided elements on the basis of the quantity of influx heat and volume of the divided elements, and calculate a predictive temperature for each of the divided elements by adding the temperature variation.

2. A control system comprising:

a predictive temperature calculator configured to divide a steel sheet in a course of heating, rolling, and cooling in a hot rolling mill into annular shaped elements for each space cutting width from an outer periphery to a center in a section thereof, calculate a temperature variation during a time increment for each of the divided elements, and calculate a predictive temperature for each of the divided elements by adding the temperature variation; and a controller configured to operate on the basis of predictive temperatures calculated by the predictive temperature calculator, to determine control amounts for the hot rolling mill to implement heating, rolling, and cooling of the steel sheet, wherein the predictive temperature calculator is configured to calculate a first quantity of influx heat during the time increment for a part of an outermost enclosure of the divided elements on the basis of radiation heat efflux, cooling heat efflux, convection heat efflux, friction heat influx, roll heat elimination, machining heat, and heat flux, calculate a second quantity of influx heat during the time increment for internal part of the divided elements on the basis of machining heat and heat flux, calculate a temperature variation during time increment for each of the divided elements on the basis of the first quantity of influx heat, the second quantity of influx heat and volume of the divided elements, and calculate a predictive temperature for each of the divided elements by adding the temperature variation.

* * * * *